US005603341A

United States Patent [19]

Johnson

[11] Patent Number: 5,603,341

[45] Date of Patent: Feb. 18, 1997

[54] STAND FOR TREATMENT OF FOOTWEAR

[75] Inventor: Gisle E. Johnson, Oslo, Norway

[73] Assignee: Trosterud Mek. Verksted A/S, Oslo, Norway

[21] Appl. No.: 446,795

[22] PCT Filed: Nov. 22, 1993

[86] PCT No.: PCT/NO93/00175

§ 371 Date: May 30, 1995

§ 102(e) Date: May 30, 1995

[87] PCT Pub. No.: WO94/12068

PCT Pub. Date: Jun. 9, 1994

[30] Foreign Application Priority Data

Nov. 30, 1992 [NO] Norway ..... 924604

[51] Int. Cl.[6] ..... B08B 3/02; B08B 9/00

[52] U.S. Cl. ..... 134/62; 134/82; 134/166 R

[58] Field of Search ..... 134/62, 82, 83, 134/84, 85, 88, 166 R, 169 R, 170

[56] References Cited

FOREIGN PATENT DOCUMENTS 534228 6/1977 U.S.S.R. ..... 134/83

*Primary Examiner*—Philip R. Coe
*Attorney, Agent, or Firm*—Young & Thompson

[57] ABSTRACT

A stand for suspension of footwear during treatment, such as washing disinfecting, blacking, impregnating and drying, wherein the stand has a piping system provided with jets for the secure retention of the footwear as well as internal washing and disinfecting thereof. The footwear is placed down onto the nozzle pipe (6) and is washed internally as detergent and disinfectant, respectively, are supplied to the stand's piping system and are sprayed out through the holes in the nozzle pipes. The stand is preferably used in a facility for treatment of footwear where the function of the stand is both to permit internal washing and disinfecting of the footwear and to hold the footwear in place during the external treatment.

5 Claims, 2 Drawing Sheets

STAND FOR TREATMENT OF FOOTWEAR

The present invention relates to a stand for washing, disinfecting, drying and optionally blacking and impregnating footwear, and the utilization of the stand In a facility or plant for treatment of footwear.

Footwear which changes users, such as military boots, rental footwear and mining and industrial footwear, must be washed, disinfected and optionally impregnated and blacked after being returned by a user and before being supplied to the next user. This applies to footwear such as shoes, boots, and pull-over boots made of materials such as hide, fur, leather, rubber, plastic or woven fabric.

Today, such treatment is basically done by hand, washing the footwear externally and internally and disinfecting it by spraying a disinfectant liquid onto the inside. Footwear that so requires is then blacked and/or impregnated. Between various of these treatment stages and at the end, if necessary, the footwear is dried.

This manual treatment is time-consuming and labor-intensive and is therefore expensive. The result of the treatment will also vary greatly according to how it is carried out, and it is difficult to control the use of energy and the discharge of water contaminated by the detergent. In addition, the impregnation agent often contains organic solvents that are not compatible with a good working environment.

From SU 534228 there is known a facility for washing, disinfecting and drying of footwear, primarily boots for mine workers. In this facility the footwear is placed with the boot leg down on vertical pipes provided with jets. The vertical pipes with their jets are mounted on a horizontal pipe, and a chain of such horizontal pipes passes through the facility. The footwear is conducted through the facility by the movement of the horizontal pipe in a parallel plane. An operator must sit and continuously place the footwear onto the pipe at one end of the facility during the entire period of operation.

From JP 2-74230(A) and 2-1552432(A) there are known arrangements for washing and disinfecting footwear. The systems shown therein are well suited for freshening up the footwear, but the footwear articles are handled individually or in pairs, and the arrangement shows no solution for the treatment of shoes on a large scale.

EP 380 433(A1) shows a facility having a stand with a piping system for drying and disinfecting footwear, such as ski boots, etc. Here the footwear is suspended on the stand which is connected to a unit that blows hot air through the stand's piping and thereby dries and disinfects the footwear. No washing, impregnation or blacking of the footwear is described here.

The purpose of the present invention is thus to procure an arrangement which affords a semi-automatic method of treatment, i.e., washing, disinfecting and drying, together with optional blacking and/or impregnation of footwear.

This objective is achieved by means of a stand for suspension of several pairs of footwear during treatment, such as washing, disinfecting, blacking, impregnating and drying of the footwear, said stand is constructed of a frame and piping system with vertical pipes between wich are disposed one or more horisontal pipes onto which are mouted a plurality of vertical nozzle pipes for the secure retention of the footwear as well as for internal washing and disinfection thereof, characterized in that the stand is adapted for transport through a facility for sequencial treatment of the footwear, that a plurality of offices serving as jets during washing and disinfection are provided in said nozzle pipes and that that the piping system has a connection means to a cooperative outlet means for detergent and disinfectant in the different units in said facility.

The present invention will now be described with reference to the attached figures, where:

Figure 1:
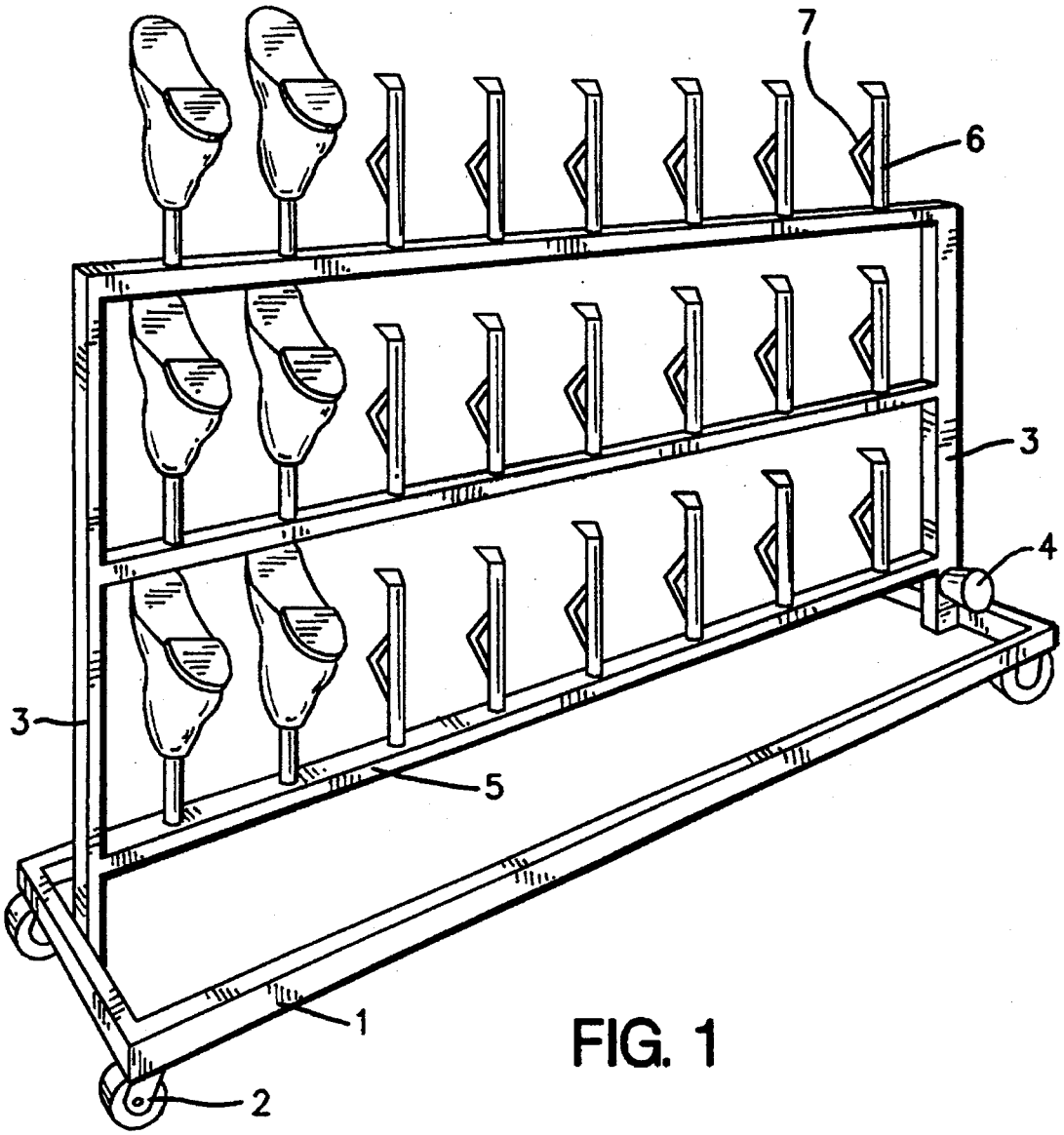
FIG. 1 is a view in perspective of a stand for footwear onto which a few pairs of footwear have been placed.
Figure 2:
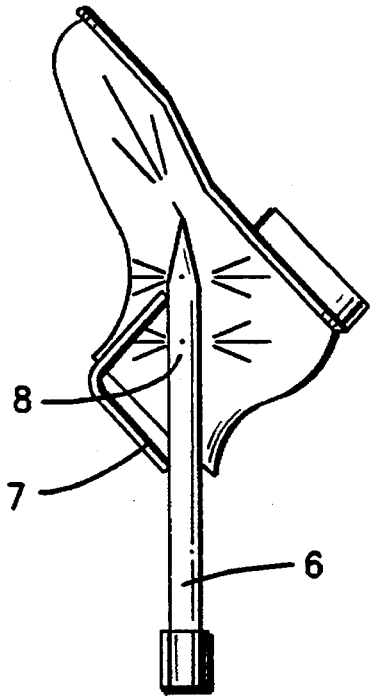
FIG. 2 is a sectional view of a shoe/boot placed on a nozzle pipe on the stud.

FIG. 1 shows a preferred embodiment of a stand according to the present Invention. The frame 1, preferably rectangular, is mounted on pivotable wheels 2 for moving the stand. The stand is built onto the frame as a well-proportioned piping system having a connection means 4 to cooperative outlet means for detergent and disinfectant, and is constructed of vertical pipes 3 between which are disposed one or more horizontal pipes 5. Onto the horizontal pipes 5 are mounted a plurality of vertical nozzle pipes 6 down onto which the footwear is placed for washing. To ensure that the footwear will be washed thoroughly on the outside, it is important that the nozzle pipes be spaced far enough apart to prevent the footwear articles from touching one another. In nozzle pipes 6 are a provided a plurality of orifices 8, which serve as jets during washing and disinfecting of the footwear. In addition, a curved bar 7 is preferably mounted on the nozzle pipes to hold out the tongue on the footwear and to keep the footwear in position during the treatment.

As shown on FIG. 1, the stand may be provided with more than one horizontal pipe 5 and nozzle pipes mounted above one another, to increase the number of pairs of footwear that the stand can accommodate. If the facility for treatment of footwear is designed with this objective in mind, or if the external washing, blacking and impregnation is not important, each stand may have two or more parallel units on which to mount the footwear.

The connection means 4 is preferably a conical connector piece cooperative with an opposing conical connector piece on an outlet means in a facility for footwear treatment.

If desired, a network of ventilation hoses, e.g., flexible ventilation hoses, may also be coupled to the piping on the stand for the internal drying of the footwear.

Figure 3:
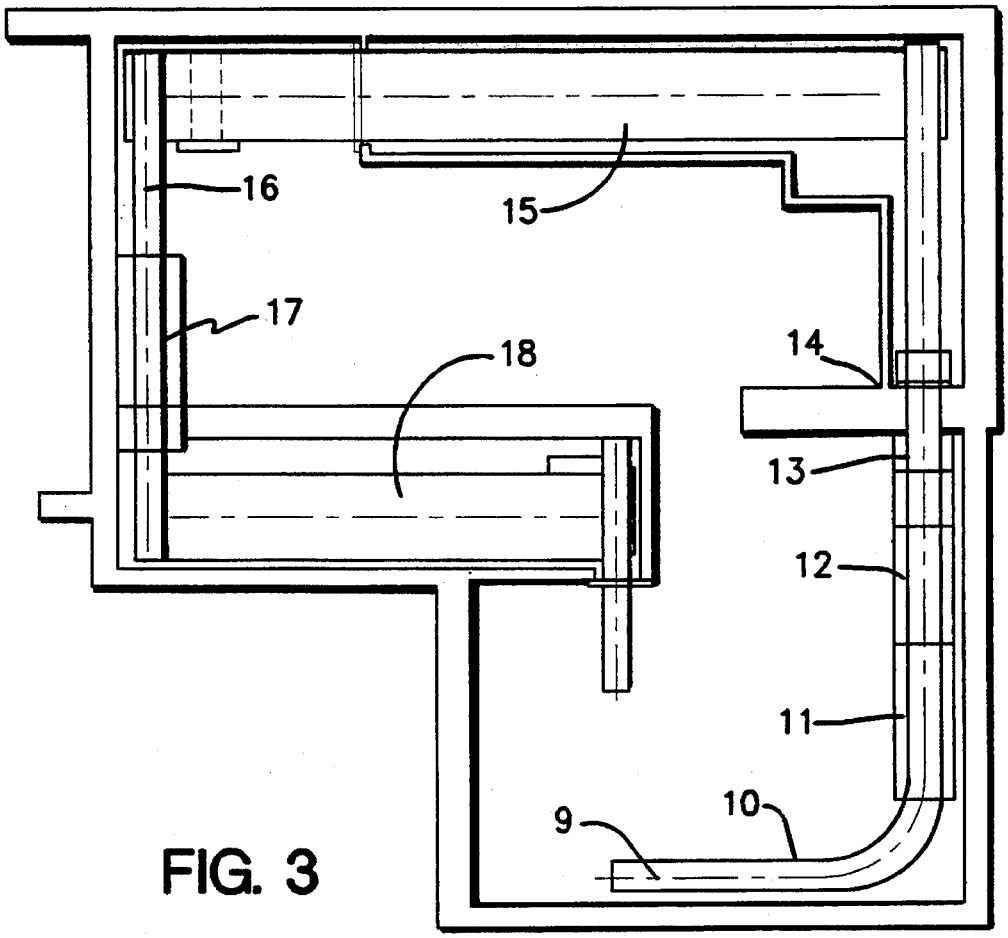
FIG. 3 is a bird's-eye view of a plant for treatment of footwear by using the stand according to the present invention.

A facility for washing, disinfecting, blacking, impregnating and drying of footwear, such as, e.g., military boots, is shown in bird's-eye view in FIG. 3. The footwear is prepared for treatment by the removal of shoelaces, insoles, and other loose pieces. The footwear is then mounted on the stands by means of loaders 9 that may be raised and lowered. As soon as the stand has been filled with footwear, it may be placed on a track 10, where it is automatically conducted through the facility in accordance with the facility's capacity and its program.

In washing unit 11 the stand is stopped, connection means 4 engages with the outlet means in the washing unit, and detergent passes through the stand and is sprayed into the inside of the footwear through orifices 8 in the nozzle pipes. The footwear is simultaneously washed externally by the spraying of detergent onto the outside through jets that produce a cutting and softening stream.

After washing is completed, the connection means is disengaged from the outlet means and the stand is conducted further to the disinfecting unit 12, where connection means 4 engages with an outlet means and disinfectant fluid is sprayed onto the inside of the footwear. Then the stand is moved further and is rinsed externally to remove excess disinfectant fluid before blacking is sprayed onto the outside in the blacking unit 13. After blacking, the stand is sent out through door 14, whereupon the excess blacking agent is blown off by pressurized air. The stand is then conducted Into a drying tunnel 15, into which air is blown countercurrently in relation to the movement of the stand. The dimensions of the drying tunnel are such that the footwear remains within the tunnel for a sufficient time to become thoroughly dry. If desired, hot air may also be injected into the footwear here by means of air hoses coupled to the piping on the stand.

After drying, the stand is moved further on track 16 through the impregnation unit 17, where the impregnation fluid is sprayed onto the outside of the footwear, before the stand passes into drying tunnel 18 where the footwear is again dried to remove the impregnation fluid's solvent.

Moving through the facility, the stand functions as a storage and transport unit, in addition to holding the footwear oriented in the proper height and position. After the treatment is finished, the stand and footwear are rolled to the packing area where the footwear is removed from the stand.

Depending on the type of footwear and according to need, some of the units in a facility like the one described above may be eliminated, their sequence may be altered, and several units may be combined into one physical entity.

The facility is preferably constructed as a closed system, which minimizes energy consumption and the discharge of environmentally dangerous agents into the working environment and to the outside environment.

I claim:

1. A stand for suspension of several pairs of footwear during treatment, said stand comprising a frame of pipes comprising vertical pipes between which plural superposed horizontal pipes extend and with one of which said horizontal pipes are in internal communication, a plurality of vertical nozzle pipes spaced apart along each of the horizontal pipes, and means to supply a liquid to said one of said vertical pipes for transport through said one vertical pipe and through said horizontal pipes and out through said vertical nozzle pipes into footwear held by said vertical nozzle pipes.

2. The stand according to claim 1, there being curved bars on each vertical nozzle pipe, both of whose ends are secured to the associated said vertical nozzle pipe, for holding out the tongue of footwear thereby to keep the footwear in position on the vertical nozzle pipes.

3. The stand according to claim 1, further comprising wheels on which the stand rolls.

4. A facility for treatment of footwear transported on a stand according to claim 1, comprising a track on which the stand is moveable through the facility, there being plural different workstations spaced apart along said track for treatment of footwear on a said stand moving through said facility.

5. The facility according to claim 4, in the form of a drying tunnel into which heated air is conducted countercurrently to the movement of the stand carrying the footwear.

* * * * *